United States Patent [19]

Zodrow

[11] 4,181,562

[45] Jan. 1, 1980

[54] LABELING MACHINE FOR BOTTLES AND THE LIKE

[75] Inventor: Rudolf Zodrow, Dusseldorf, Fed. Rep. of Germany

[73] Assignee: Jagenberg-Werke Aktiengesellschaft, Dusseldorf, Fed. Rep. of Germany

[21] Appl. No.: 900,688

[22] Filed: Apr. 27, 1978

[30] Foreign Application Priority Data

Jul. 2, 1977 [DE] Fed. Rep. of Germany ..... 2730030

[51] Int. Cl.[2] ..... B65C 9/16; B65H 3/20

[52] U.S. Cl. ..... 156/568; 156/571; 156/578; 156/DIG. 32; 271/33; 118/231

[58] Field of Search ..... 156/567, 568, 571, 578, 156/DIG. 29, DIG. 30, DIG. 32; 271/33; 118/220, 231, 236, 240

[56] References Cited

U.S. PATENT DOCUMENTS

| | | | |
|---|---|---|---|
| 3,546,047 | 12/1970 | Dullinger | 156/571 |
| 3,735,731 | 5/1973 | Tavernier | 156/571 X |
| 3,919,040 | 11/1975 | Zodrow | 156/571 |
| 3,923,589 | 12/1975 | Tavernier | 156/571 X |
| 3,928,120 | 12/1975 | Zodrow | 156/571 X |
| 4,077,621 | 3/1978 | Knuppertz et al. | 156/571 X |

*Primary Examiner*—Michael G. Wityshyn

*Attorney, Agent, or Firm*—Sprung, Felfe, Horn, Lynch & Kramer

[57] ABSTRACT

A cam-controlled equalizing transmission is provided in a labeling machine for bottles and the like having a revolving carrier on which at least one pickup element having an outwardly curved receiving surface for labels is rotatably and eccentrically mounted between the receiving surface and its center of curvature thereof, and having one drive for each pickup element including a stationary sun gear and a pinion which meshes with the sun gear and which is axially displaceable in relation to the sun gear. The cam-controlled equalizing transmission couples the drive spindle of the pickup element with the pinion and comprises a cam disposed between the pinion and the spindle and a cam follower, wherein the cam has a varying curvature.

3 Claims, 4 Drawing Figures

22
6
1
24
16
25
17
30a
36
36a
27
II
II
37
34
30c
30
30b
39
38
32
31
35
33
2
26
28
29
23

LABELING MACHINE FOR BOTTLES AND THE LIKE

BACKGROUND

The invention relates to a labeling machine having a revolving carrier on which at least one pickup element having an outwardly curved receiving surface for labels is rotatably and eccentrically mounted, especially between the receiving surface and its center of curvature, and having a drive for each pickup element, which consists of a stationary sun gear and a pinion which meshes with the sun gear, is displaceable axially in relation to the sun gear, and is coupled by a cam-controlled equalizing transmission to the drive spindle of the pickup element.

In a known labeling machine of this kind (DT-OS 2,325,244) the equalizing transmission consists of a steep screw thread between the pinion and the drive spindle of the pickup element. The cam control means for the equalizing transmission consists of an axial cam groove in which a cam follower in the form of a roller is guided. The cam-controlled equalizing transmission brings about, with the carrier running at constant angular velocity, that the constant angular velocity originating from the planetary drive has superimposed on it the angular velocity produced by the axial displacement of the pinion on the steep thread, so that the rotatory movement of the pickup element is not uniform but is accelerated and retarded. This acceleration and retardation of the pickup element is necessary for the purpose of obtaining a full rolling movement of the cylindrically curved receiving surface of the pickup element which is mounted between the center of curvature and the receiving face.

In a labeling machine of the initially described kind, it has been proposed (German Patent Application P 2619067.0-27), that, as the equalizing transmission, the pinion bear two oppositely situated cam members each extending over only a portion of the spindle circumference, and with each of which there is associated one of two diametrically opposite cam follower members in the form of rollers journaled on the drive spindle. To eliminate any play that may be present between the cam members and the cam followers, their distance from one another is adjustable. This labeling machine has the advantage over the known labeling machine that the play that is present on account of the steep thread in the known labeling machine, which is due to conditions involved in design and construction, can be eliminated, so that a more perfect rolling movement can be assured, especially at high outputs. Since each roller always cooperates with only one cam member, in the event of a thrust reversal, the roller revolving in one particular direction is disengaged from the corresponding cam member and can continue to rotate. This reduces the wear to a minimum. Since the roller can continue to roll, it does not have to be accelerated from a standstill in the event of another thrust reversal. Wear is also reduced by the fact that the rollers do not have to be displaced from their opposed position, in which they roll on an optimum path on the cam members, for the elimination of free play. Since the wear is slight and the additional rotatory movement required for the acceleration and retardation of the pickup elements amounts to very little, the opposed arrangement of the rollers can be selected with correspondingly short cam members.

In the embodiment of the earlier proposal, the cam members have a constant slope. If the additional rotation required for the acceleration and retardation of the pickup elements is different, this signifies a different stressing of the cam members on their length.

THE INVENTION

The invention is addressed to the problem of creating a labeling machine of the initially mentioned kind, in which the stressing of the equalizing drive is as small as possible.

This problem is solved by the invention in that the equalizing drive consists of a cam with a cam follower, which is disposed between the pinion and the spindle, the cam having a varying curvature.

In the labeling machine of the invention, the local stresses on the cam of the equalizing drive can be kept free of peaks by coordinating the slope of the cam of the equalizing drive with the slope of the control cam. The shifting of the load from the cam of the equalizing drive to the control cam is uncritical, since this cam has a substantially greater length than the cam of the equalizing drive.

For the purpose of eliminating play due to design or to wear, the cam, in one embodiment of the invention, consists of two parallel cam members whose distance from one another is adjustable such that any existing clearance between them and the cam follower can be eliminated. In this embodiment, the two cam members have an axial guide means which secures them against turning when their distance apart is adjusted. The security against turning assures that the cam follower will be able to move without binding on the cam even after the adjustment.

According to another embodiment of the invention, the cam members are disposed oppositely, and with each of them there is associated one of two cam followers mounted diametrically opposite one another for rotation on the drive spindle, and constructed as rollers.

BRIEF DESCRIPTION OF THE DRAWINGS

The invention will now be explained with the aid of the drawings representing an example of its embodiments. In the drawings.

DETAILED DESCRIPTION OF THE INVENTION

Figure 1:
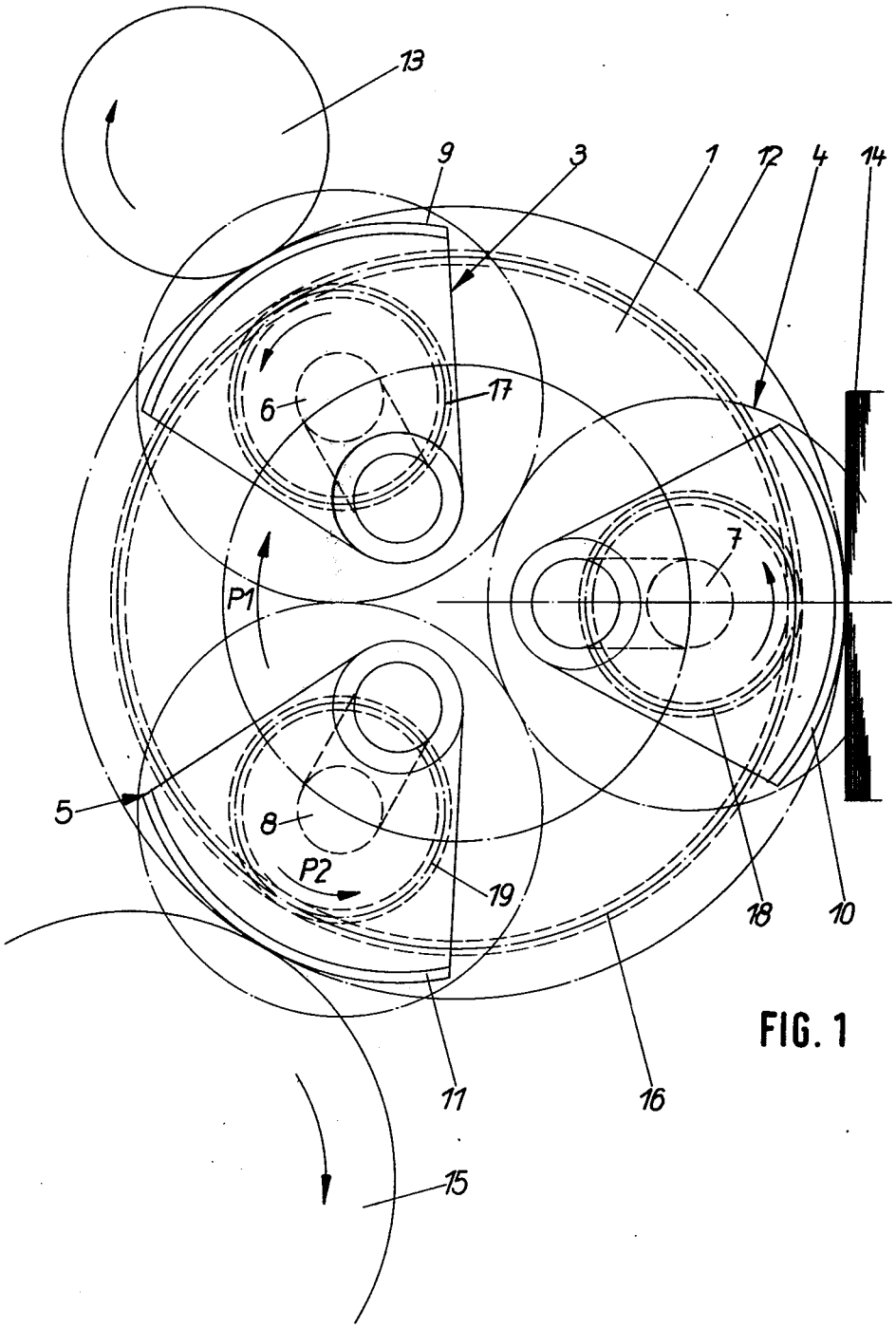
FIG. 1 is a diagrammatic top plan view of a labeling machine.
Figure 2:
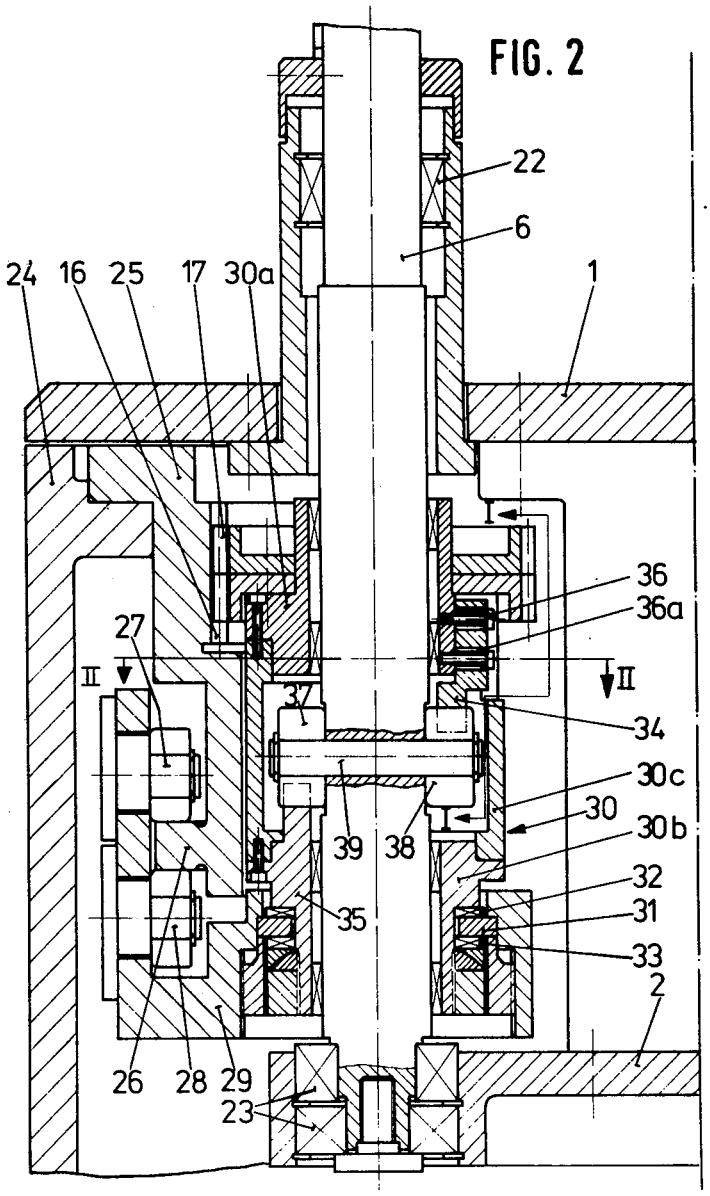
FIG. 2 is an axial cross-sectional view taken through an equalizing drive, with cam control, of a pickup element in a labeling machine of FIG. 1.

The labeling machine shown in FIGS. 1 and 2 has as its carrier an upper, circular plate 1 and a lower circular plate 2 in which drive spindles 6, 7 and 8 are eccentrically journaled for pickup elements 3, 4 and 5. The drive spindles 6 to 8 are disposed symmetrically with the cylindrically curved receiving surfaces 9, 10 and 11, between the receiving surfaces 9, 10 and 11 and their center of curvature. Tangential to the circle 12 defined by the receiving surfaces 9, 10 and 11 when in their centered position are the various stations, namely a revolving gum roller 13, a stationary stack of labels 14 presenting a flat front, and a rotating labeling cylinder 15.

The means for the driving of the pickup elements 3, 4 and 5 is a stationary sun gear 16 with which pinions 17, 18 and 19 provided on the drive spindles 6, 7 and 8 mesh. Upon the rotation of the carrier 1, 2 in the direction of the arrow $P_1$, the pickup elements 3, 4 and 5 revolve in the direction of the arrow $P_2$, and hence oppositely to the carrier 1, 2, and oppositely to the glue roller 13 and the labeling cylinder 15. Each drive spindle 6 is held rotatably but axially non-displaceably by a sleeve inserted in the upper plate 1 and having a bearing 22, and by bearings 23 in the lower plate. The pedestal 24 of the labeling machine bears a stationary, annular component 25 which bears the stationary sun gear 16 in the inside of its upper portion, and an annular cam rail 26 on the outside of its lower portion. The cam rail 26 is followed on both of its faces by a pair of rollers 27, 28, which are held on a bearing bracket 29 in adjustable eccentric bearings. The bearing bracket 29 is held against axial displacement on the part 30 rotatably mounted on the drive spindle by the fact that it has a ring 31 gripped between two axial thrust bearings 32, 33. If, then, an axial displacement of the bearing bracket 29 is brought about by the cam rail 26, part 30 will also be displaced axially on the spindle 6.

The pinion 17 meshing with the sun gear 16 is fastened non-rotatably to the upper part of part 30. The pinion 17 is divided in two perpendicular to its axis, so that the two parts can be turned one against the other. This possibility of tightening and turning makes it possible to eliminate any play between the flanks of the teeth of sun gear 16 and those of the pinion 17.

Figure 3:
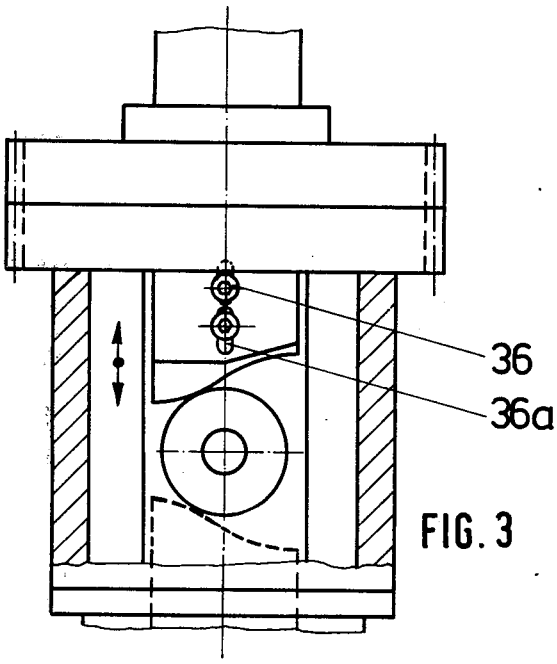
FIG. 3 is a fragmentary view taken along line I—I through the equalizing drive of FIG. 2.
Figure 4:
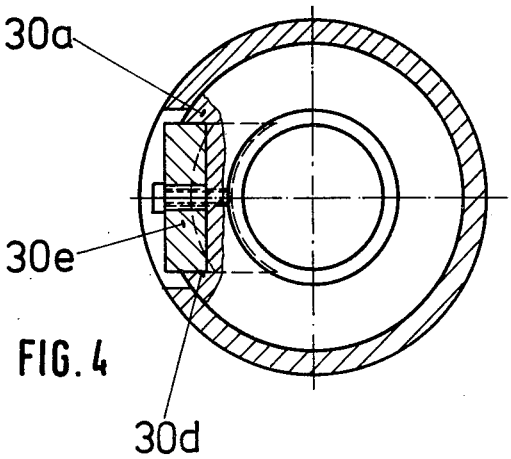
FIG. 4 is a cross-sectional view taken along line II—II through the equalizing drive of FIG. 2.

Part 30 bears two parts 30*a*, 30*b*. These two parts have cam members 34, 35, of parallel configuration, facing one another on opposite sides of the drive spindle 6. The curvature of the two cams is not constant, as shown in FIG. 3. The part 30*b* bearing the lower cam part 35 is fastened non-rotably and axially undisplaceably by means of a sleeve 30*c*. Furthermore, the part 30*a* bearing the upper cam member 34 is fastened non-rotatably to part 30. This part 30*a*, however, is axially displaceable in relation to part 30. An axial groove 30*d* in part 30 and an axial spring 30*e* on part 30*a* serves for this purpose. Set screws 36 inserted in axially disposed elongated holes 36*a* serve to fasten part 30*a* to part 30. This type of fastening and axial guidance makes it possible to vary the distance between the two cam members 34, 35, while preserving their relative angular position.

One of the rollers 37, 38, mounted diametrically opposite one another on an axis 39 passing through the drive spindle, cooperates with each of these two cam members 34, 35.

When the carrier 1, 2, rotates, the pinion 17 is revolved. The pinion 17 sets component 30 in rotation, which transfers the torque through cam members 34, 35, and the rollers 37, 38, to the spindle 6. As long as the cam control 26–28 does not axially displace the component 30, the rollers 37, 38, do not change their position on the cam members 34, 35. Upon the rotation of carrier 1, 2, at constant angular velocity, the pickup elements accordingly also rotate at constant angular velocity. However, if the cam control 26–28 shifts component 30 axially, this results in a displacement of the rollers 37, 38, on the cam pieces 34, 35, and hence in an acceleration or retardation of the rotatory movement derived from the pinion 17.

In the labeling machine of the invention, the shape of the curves of the two cam members 34, 35, is coordinated with that of the cam rail 26 such that no shock loads occur on the relatively short cam members 34, 35. The invention thus permits an optimum load distribution between the cam members 34, 35 and the cam rail 26. Furthermore, the play between the cam members 34, 35, and rollers 37, 38, can be eliminated in spite of the irregular curvature of the two cam members without seizing of the rollers 37, 38, between the cams.

It will be appreciated that the instant specification and claims are set forth by way of illustration and not limitation, and that various modifications and changes may be made without departing from the spirit and scope of the present invention.

What is claimed is:

1. In a labeling machine for bottles and the like having a revolving carrier on which at least one pickup element having an outwardly curved receiving surface for labels is rotatably and eccentrically mounted between the receiving surface and the center of the curvature thereof relative to the axis of rotation of the carrier, and having one drive for each pickup element including a stationary sun gear for all of the pickup elements, a drive spindle for each pickup element and a pinion therefor which meshes with the sun gear and is axially displaceable in relation to the sun gear, wherein the improvement comprises equalizing transmission means for coupling the drive spindle of each pickup element with its associated pinion comprising first cam means having a cam surface of varying curvature driven by the pinion and a cam follower in contact with the cam surface to drive the drive spindle and second cam means for axially displacing the pinion and a portion of the first cam means along the drive spindle to change the position of the cam follower on the cam surface of varying curvature to effect an acceleration or retardation of the rotary movement of the drive spindle.

2. The labeling machine according to claim 1, wherein the first cam means comprises two cam members each having cam surfaces of corresponding varying curvative and the cam follower comprises two cam following elements, and means mounting same for adjusting the therebetween such that any free play present between them and the cam following elements can be eliminated, the mounting means including guiding means which secures the two cam members against turning about an axis perpendicular to the axis of the spindle when their spacing is adjusted.

3. The labeling machine according to claim 2, wherein the cam members are disposed diametrically opposite about the drive spindle, with each having associated therewith one of the two cam following elements disposed diametrically opposite one another and wherein the cam followers comprise roller bodies mounted to revolve with the spindle and rotate about an axis perpendicular to the axis of the drive spindle.

* * * * *